United States Patent [19]

Kausel et al.

[11] 4,164,328

[45] Aug. 14, 1979

[54] VIBRATORY BALL OR TUBE MILL

[75] Inventors: Ernst Kausel, Lima, Peru; Helmut Haas, Cologne, Fed. Rep. of Germany

[73] Assignee: Klöckner Humboldt Deutz Aktiengesellschaft, Fed. Rep. of Germany

[21] Appl. No.: 833,249

[22] Filed: Sep. 14, 1977

Related U.S. Application Data

[63] Continuation-in-part of Ser. No. 702,056, Jul. 2, 1976, abandoned.

[51] Int. Cl.[2] ..... B02C 17/14

[52] U.S. Cl. ..... 241/175; 241/137

[58] Field of Search ..... 241/137, 140, 153, 156, 241/175; 198/760, 767, 770

[56] References Cited

U.S. PATENT DOCUMENTS

| | | | |
|---|---|---|---|
| 2,760,727 | 8/1956 | Mittag et al. | 241/137 |
| 2,982,485 | 5/1961 | Fahrenwald | 241/175 |
| 2,993,585 | 7/1961 | Musschoot | 198/760 |
| 3,991,948 | 11/1976 | Schober et al. | 241/175 |

FOREIGN PATENT DOCUMENTS

| | | | |
|---|---|---|---|
| 2316282 | 10/1974 | Fed. Rep. of Germany | 241/175 |
| 2427907 | 1/1975 | Fed. Rep. of Germany | 198/760 |

OTHER PUBLICATIONS

"Vibrating Mill", Allis-Chalmers Publication, Dec. 1961.

*Primary Examiner*—Howard N. Goldberg
*Attorney, Agent, or Firm*—Hill, Van Santen, Steadman, Chiara & Simpson

[57] ABSTRACT

A ball or tube mill which includes at least one grinding compartment, support means for supporting the grinding compartment, drive means for eccentrically driving the grinding compartment and a plurality of inflatable bellows supporting the support means for oscillating movement. In a preferred form of the invention, the support means is supported on four spaced inflatable bellows inclined with respect to one another such that their central axes intersect at a cone apex above the center of the mill. Means may also be provided for adjusting the pressure within each of the bellows to thereby adjust the height of the bellows individually.

2 Claims, 3 Drawing Figures

VIBRATORY BALL OR TUBE MILL

REFERENCE TO RELATED APPLICATION

This application is a continuation-in-part of our copending U.S. application Ser. No. 702,056 filed July 2, 1976, now abandoned.

BACKGROUND OF THE INVENTION

1. Field of the Invention

This invention is in the field of ball or tube mills and is directed specifically to supporting the mill for controlled oscillation during rotation of the contents of the mill to thereby improve the grinding efficiency.

2. Description of the Prior Art

From the technical literature for the mechanics of the ball mill, for example, the publication "Chemie-Ingenieur-Technik" 1964, pages 125 to 130, it is stated that the grinding output of a ball mill increases in a continuously operating ball mill, the output yield being proportional to the second power of the oscillation amplitude and to the third power of the oscillatory frequency according to the equation:

$$D=K_1 \cdot \alpha^2 \cdot n^3$$

where

D is the grinding output, or yield, for example in metric tons per hour, $\alpha$ is the oscillation amplitude, n is the rate of rotation of the unbalanced drive, and $K_1$ is a proportionality constant.

Previously, an increase in the output of the ball mill was accomplished by increasing the rate of rotation of the unbalanced drive on the assumption that the grinding yield or output increases more rapidly with increasing rate of rotation than with increasing amplitude. The oscillatory amplitude of the ball mill was therefore held relatively small.

SUMMARY OF THE INVENTION

The present invention provides an improved ball or tube mill which includes at least one grinding tube, support means for supporting the grinding tube, drive means for eccentrically driving the grinding tube, and a plurality of spaced inflatable bellows supporting the support means for oscillating movement. The support means is preferably supported on four spaced inflatable bellows inclined with respect to one another such that their central axes intersect in a cone apex above the center of the mill. The bellows are provided with adjustment means for adjusting the pressure within each of the bellows to thereby adjust the height of the bellows individually. The bellows are operated at pressures ranging from approximately 0.5 to 1.0 bar (750mm) above atmospheric pressure. The mill is rotated eccentrically to cause rapid circular oscillations, thereby giving the mill an oscillation radius greater than 15mm, and preferably at least 20mm. By "oscillation radius" we mean the extent of oscillation in one direction. An oscillation radius of 15mm would amount to a total oscillation displacement of 30mm.

DESCRIPTION OF THE PREFERRED EMBODIMENTS

It has now been found through tests that the output of a ball mill can be substantially increased by increasing the oscillation radius, and that the increase in oscillation radius is much more effective than increasing the oscillation frequency. Specifically, we have found that the following approximate relationship holds:

$$D=K_2 \cdot \alpha^{2.2} \cdot n^1$$

where

D is the grinding output, or yield $\alpha$ is the oscillation radius n is the rate of rotation of the unbalanced drive, and $K_2$ is another proportionality constant.

The above approximation holds good in the ordinary rate of rotation of normal non-synchronous motors.

In the preferred form of the present invention, a ball or tube mill, provided with at least one grinding tube is connected to a support structure having a central eccentric drive. The support structure is oscillatably supported on resilient means on a frame which permits the grinding tube to have an oscillation radius of greater than 15mm. The resilient means are preferably pressurized air bellows. These air bellows can be pumped up selectively to vary their spring or elastic characteristics as required. In order to be able to absorb acceleration forces in the horizontal plane, the support means may be supported both in the vertical and horizontal directions through pressurized bellows.

Figure 1:
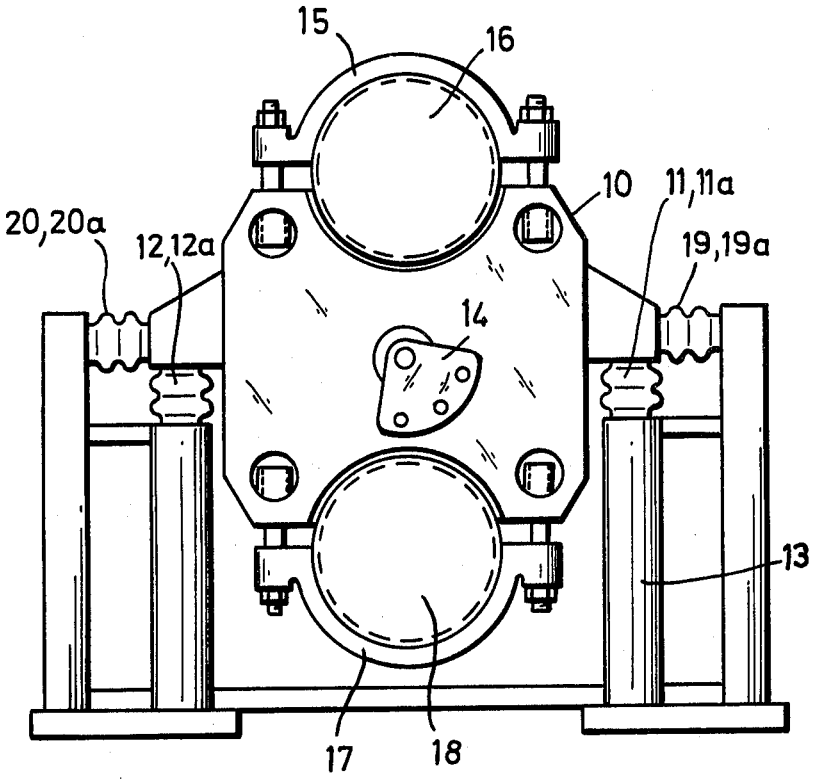
FIG. 1 is an elevational view of a ball mill assembly which can be used for the purposes of the present invention.

Turning now to the drawing, in FIG. 1 reference numeral 10 has been applied to a pair of spaced carrier plates of which the forward one is seen in the drawing. The plates 10 are oscillatably positioned on a frame structure 13 by means of four pressurized bellows 11, **11*a*, 12 and 12*a*. A centrally located eccentric drive means 14 causes the carrier plates 10 to be set into rapid circular oscillation. An upper grinding tube 16 is fixed to the upper side of the carrier plates 10 by means of a clamp 15 and on the lower side of the carrier plates 10 there is fixed a lower grinding tube 18 by means of a clamp 17**. The grinding tubes may be located in a common vertical plane one below the other, as shown, or they may be arranged in horizontal planes adjacent to each other.

The grinding tubes 16 and 18 contain hard grinding balls as well as the material to be ground. The oscillation radius transferred to the grinding tubes 16 and 18 is high and, for example, can amount to 20 to 25mm at a rate of rotation of the eccentric drive means 14 from 900 to 1500 revolutions per minute. The ball mill according to the invention, as compared with previous ball mills, has a substantially increased output yield in metric tons per hour with equivalent degrees of comminution.

The four resilient, pressurized bellows 11, **11*a*, 12 and 12*a* distributed about the circumference of the ball mill are adjustable in their elastic characteristics by the degree of pressurization. In addition, the ball mill is supported on pressurized bellows 19, 19*a*, 20 and 20*a* which have their lines of force operating in the horizontal direction. These additional bellows are preferably arranged diagonally so that their lines of effect intersect substantially at the center of the ball mill. It is also possible to arrange the bellows 11, 11***a*, 12 and 12*a* not in the vertical direction but with effective directions inclined upwardly to one or another and thereby eliminate the additional bellows 19, 19*a*, 20 and 20*a*.

Figure 2:
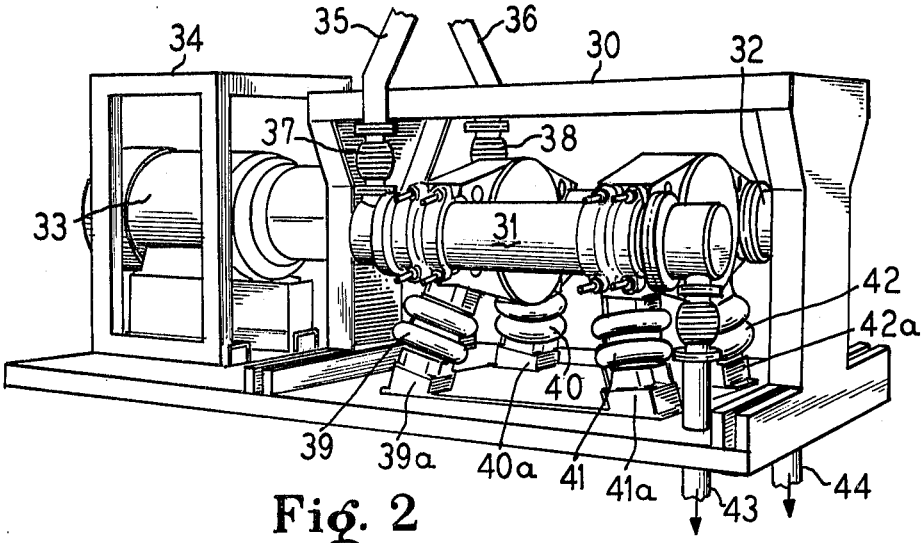
FIG. 2 is a view in perspective of a tube mill employing the principles of the present invention.

The tube mill of FIG. 2 illustrates a modified form of the invention including a frame 30 which supports a pair of grinding tubes 31 and 32 for rotation therein. Such rotation is provided by means of a drive motor 33 disposed in a housing 34.

A pair of inlets 35 and 36 deliver the material to be pulverized through a pair of flexible connections 37 and 38, respectively, into the tubes 31 and 32. The two tubes are shown supported on angularly extending bellows 39, 40, 41 and 42. Each of these bellows is individually provided with compressed air through inlets 39*a*, 40*a*, 41*a* and 42*a*, respectively.

The four compressed air bellows for the mill shown in FIG. 2 are inclined with their axes upwardly with respect to one another, and these axes cross at an imaginary cone-apex in the center of the mill. The four compressed air bellows are thereby stressed not only linearly in the axial direction but also transversely through transverse forces.

The air pressure in the bellows 39 through 42, inclusive, varies depending upon the size of the bellows and the size of the installation but normally it will be approximately 0.5 to 1.0 bar (750mm) above atmospheric pressure. The four bellows 39 to 42 are pressurized until their height, or horizontal inclination, and transverse inclination, i.e., all 6 degrees of freedom with respect to the alignment of the drive shaft of the driving motor 7 assume their correct operating positions with respect to the inlets 35 and 36 and the outlets 43 and 44 about the grinding tubes.

The pressurization of the bellows does not significantly change the size of the oscillation radius of the ball mill. This radius is rather controlled by alteration of the driving means such as the imbalance gear 14 shown in FIG. 1.

Figure 3:
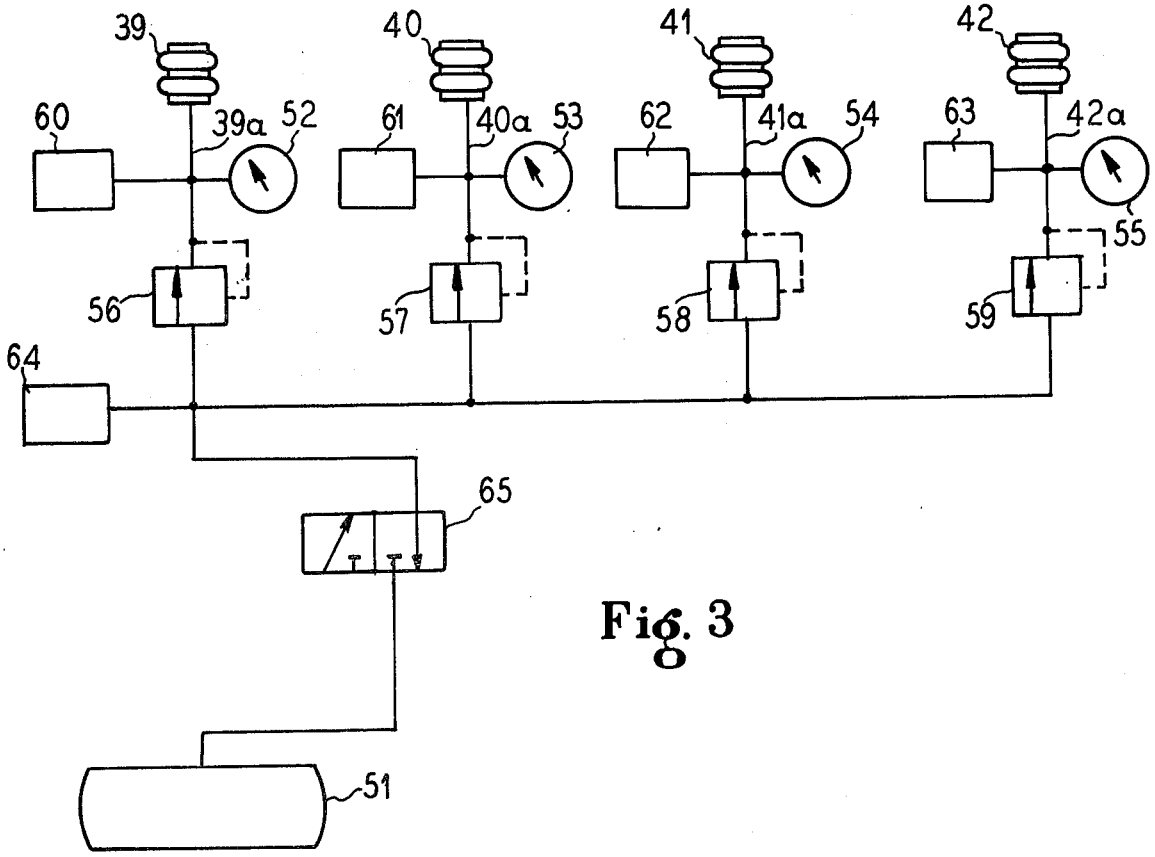
FIG. 3 is a schematic diagram showing a control system which can be used for the mills of the present invention.

In FIG. 3 there is shown diagrammatically a system for compressed air through which the air pressure in the four compressed air bellows 39 to 42 may be automatically held constant. To achieve this result, the bellows 39 to 42 are connected through their inlets 39*a* through 42*a* with a compressed air storage tank 51. The pressures in each of the compressed air bellows 39 through 42 can be read by means of manometers 52, 53, 54 and 55, respectively.

Individual pressure regulators 56, 57, 58 and 59 are provided for individual adjustment and constant maintenance of the desired air pressure in the particular bellows. Each pressure line is also provided with a separate pressure monitor 60, 61, 62 and 63 for automatically maintaining the desired air pressure constant in each of the bellows 39 to 42. These pressure monitors include safety valves which operate to disconnect the driving motor on the mill if, for example, one of the compressed air supply conduits 39*a* through 42*a* is broken and the air pressure within the corresponding bellows should drop spontaneously. An excess pressure valve 64 is also provided to operate an alarm in the event that there is an excessive pressure developed in the compressed air system. Removal of pressure from the bellows can be accomplished by manipulation of a pressure discharge valve 65.

From the foregoing, it will be understood that the mill according to the present invention is oscillatively supported on compressed air bellows capable of being pressurized to produce unusually large oscillation radii, with the driving position of the grinding tubes being exactly adjustable. This operation is substantially superior to prior spring or pneumatically supported ball or tube mill installations which were stressed only linearly in the direction of the spring axis and in no case transversely thereto. Consequently, the compressed air bellows of the present invention exhibit substantial transverse movement with appreciable transverse forces since the ball mill does not oscillate linearly but circularly or approximately circularly.

It will be evident that various modifications can be made to the described embodiments without departing from the scope of the present invention.

We claim as our invention:

1. A vibrating ball or tube mill which pulverizes a continuous flow of crushable material, said mill comprising:

a base, at least one grinding tube, a mounting means for mounting said grinding tube, drive means for eccentrically driving said grinding tube, four selectively pressurizable inflatable bellows each attached to and extending upwardly and inwardly from said base to said mounting means, each said bellows having a central axis, said bellows being inclined with respect to each other such that their central axes intersect an apex above a central portion of said mill, said bellows stressed in both the axial and transverse directions, said mill in operation generating an oscillation radius greater than 15 mm; and a means for selectively adjusting the pressure within each of the bellows, such that the height of each of the bellows above the base may be selectively individually varied to adjust the position of the mounting means and the grinding tube mounted thereon.

2. A ball or tube mill according to claim 1, in which: the pressure within said bellows is approximately 0.5 to 1.0 bar above atmospheric pressure.

* * * * *